United States Patent [19]

Nakajima et al.

[11] 4,382,673

[45] May 10, 1983

[54] TRANSFER DEVICE

[75] Inventors: Shunichi Nakajima, Yokohama; Toshimasa Takano, Sagamihara; Shinichi Hashimoto, Fujisawa, all of Japan

[73] Assignee: Tokyo Shibaura Denki Kabushiki Kaisha, Kawasaki, Japan

[21] Appl. No.: 245,977

[22] Filed: Mar. 20, 1981

[30] Foreign Application Priority Data

| | | | |
|---|---|---|---|
| Mar. 25, 1980 | [JP] | Japan | 55/38051 |
| Mar. 25, 1980 | [JP] | Japan | 55/38052 |
| Mar. 26, 1980 | [JP] | Japan | 55/38653 |
| Mar. 26, 1980 | [JP] | Japan | 55/38654 |

[51] Int. Cl.[3] ..... G03G 15/00; G03G 15/16; G03G 13/00

[52] U.S. Cl. ..... 355/3 TR; 355/14 TR; 355/3 R; 118/651; 118/656

[58] Field of Search ..... 355/3 TR, 3 R, 14 TR, 355/14 R; 428/425; 118/651, 637, 652, 656; 427/16, 24

[56] References Cited

U.S. PATENT DOCUMENTS

| | | | |
|---|---|---|---|
| 3,847,119 | 11/1974 | Hoffman et al. | 355/3 TR X |
| 3,959,573 | 5/1976 | Eddy et al. | 355/3 TR X |
| 3,993,021 | 11/1976 | Kline | 355/3 TR X |
| 4,183,655 | 1/1980 | Umahashi et al. | 355/3 TR |

FOREIGN PATENT DOCUMENTS

| | | |
|---|---|---|
| 2156299 | 5/1972 | Fed. Rep. of Germany . |
| 2164527 | 6/1973 | Fed. Rep. of Germany . |

*Primary Examiner*—A. C. Prescott

*Attorney, Agent, or Firm*—Cushman, Darby & Cushman

[57] ABSTRACT

A transfer device is for transferring a toner image formed on the surface of a photosensitive drum to a copying paper. The transfer device comprises a rotatable transfer roller facing the drum and pressing the copying paper to the surface of the drum. The transfer roller has elasticity to press elastically the copying paper to the surface of the drum thereby contacting with wider area, and includes a core provided with an outer circumferential surface, an electrically conductive layer provided on the outer circumferential surface of the core, and a great number of electrically conductive furs projected from the outer circumferential surface of the electrically conductive layer.

11 Claims, 11 Drawing Figures

TRANSFER DEVICE

BACKGROUND OF THE INVENTION

This invention relates to a transfer device provided with a transfer roller, more specifically to a transfer device for electrostatically transferring a toner image from an image forming body to a copying medium.

In the field of electrostatic copying apparatus, for example, there have recently been proposed transfer devices in which a toner image is transferred to a sheet of copying paper as a copying medium by means of a transfer roller.

The transfer roller is composed of a sponge roller whose outer circumferential surface is covered with electrically conductive rubber or plastics impregnated with pulverized molybdenum sulfide, and an electrically conductive silicon tube covering the outer circumferential surface of the sponge roller. The transfer roller can be in rolling contact with the outer circumferential surface of an image forming body, such as e.g. a photosensitive drum. A bias potential is applied to the outer circumferential surface of the transfer roller. In a transfer operation, a sheet of copying paper is interposed between the contact surfaces of the photosensitive drum and the transfer roller so that a toner image formed on the photosensitive drum is electrostatically transferred to the copying paper. In cleaning the transfer roller after completion of the transfer process, moreover, a cleaning blade usually formed of rubber or plastics is held against the outer circumferential surface of the transfer roller to scrape off toner particles attached to the circumferential surface of the transfer roller.

There are two important requirements of the transfer device of this type; improved transfer efficiency and satisfactory cleaning effect.

In order to obtain the satisfactory cleaning effect, the surface of the transfer roller need be smooth and low in frictional resistance. Therefor, the surface of the transfer roller need be hard.

In order to improve the transfer efficiency, on the other hand, it is essential to increase the contact area of the transfer roller on the photosensitive drum. Therefore, the surface of the transfer roller need be soft.

Thus, with the aforementioned conventional construction of the transfer roller, it has been impossible to fulfill those two requirements at the same time.

SUMMARY OF THE INVENTION

It is therefore an object of the present invention to provide a transfer device using a brush-roll type transfer roller capable of ensuring both improved transfer efficiency and satisfactory cleaning effect.

According to one aspect of the present invention, there is provided a transfer device for transferring a toner image formed on the surface of an image forming body to a copying medium, which comprises a rotatable transfer roller facing the image forming body and pressing the copying medium to the surface of the image body, the improvement in which the transfer roller has elasticity to press elastically the copying medium to the surface of the image forming body thereby contacting with wider area, and includes a core provided with an outer circumferential surface, an electrically conductive layer provided on the outer circumferential surface of the core, and a great number of electrically conductive furs projected from the outer circumferential surface of the electrically conductive layer.

BRIEF DESCRIPTION OF THE DRAWINGS

FIGS. 1 to 7 show a transfer device according to a first embodiment of this invention, in which FIG. 1 is a schematic view of an electrostatic copying apparatus in which the transfer device is used, FIG. 2 is a cross-sectional view of the transfer device of the copying apparatus, FIG. 3 is a perspective view showing the arrangement of rollers of the transfer device, FIG. 4 is a partial cross-sectional view of a transfer roller, FIG. 5 is a circuit diagram for illustrating the principle of the electrostatic fur planting method, FIG. 6 is a perspective view of a second fur-brush roller for cleaning.

DETAILED DESCRIPTION OF THE PREFERRED EMBODIMENTS

Figure 1:
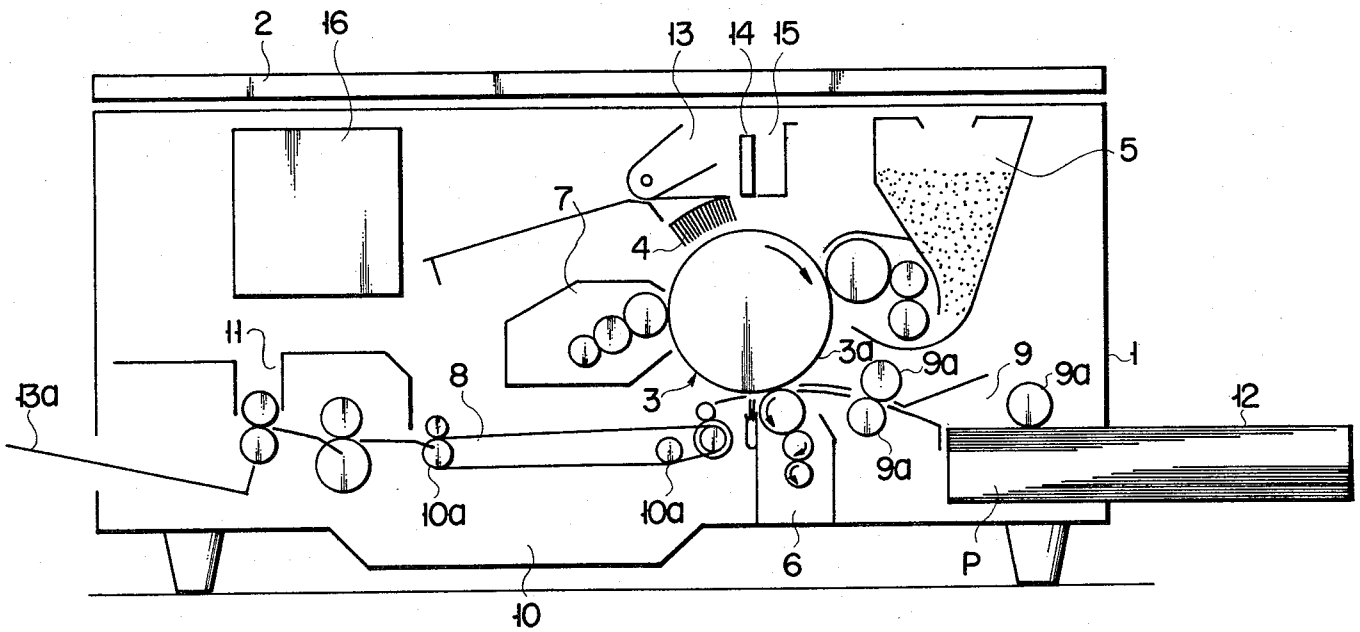

Now there will be described a transfer device according to a first embodiment of this invention applied to an electrostatic copying apparatus with reference to the accompanying drawings. In FIG. 1, reference numeral 1 designates the main body of an electrostatic copying apparatus. An original carriage 2 is set on the top of the apparatus body 1 so as to be able to reciprocate thereon. Further, an image forming body, e.g. a photosensitive drum 3, is pivotally mounted near the central portion of the interior of the apparatus body 1 so as to be able to rotate along the clockwise direction. The photosensitive drum 3 comprises a cylindrical body of aluminum whose outer circumferential surface is coated with a photosensitive layer 3*a* of zinc oxide. On the periphery of the photosensitive drum 3, there are arranged a charger 4, a developing device 5, a transfer device 6, and a cleaning device 7 in this order along the rotating direction of the drum 3. These peripheral devices are in contact with the photosensitive layer 3*a* or the circumferential surface of the photosensitive drum 3. Thus, there is provided a contact-type copying apparatus.

At the lower inside portion of the apparatus body 1 lies a paper path 8 which extends via the transfer device 6 along the longitudinal direction of the apparatus body 1. Along the paper path 8, there are successively arranged a paper feed mechanism 9 including a plurality of paper feed rollers 9*a*, the transfer device 6, a paper discharge mechanism 10 including a plurality of paper discharge rollers 10*a*, and a fixer 11, starting at the proximal end side of the paper path 8. A feed paper cassette 12 is removably attached to the proximal end of the paper path 8. A paper discharge tray 13*a* is removably attached to the apparatus body 1 at the distal end portion of the paper path 8. Symbol P designates sheets of copying paper or copying medium stored in a pile in the feed paper cassette 12.

An illumination system 13 including an illumination lamp is disposed at the upper portion inside the apparatus body 1, while an exposure device 15 having an optical fiber lens 14 is provided on the upper side of the photosensitive drum 3 inside the apparatus body 1.

Further, reference numeral 16 designates a driving motor which drives the aforesaid mechanical units, rotates the photosensitive drum 3 in the direction of the arrow, and reciprocates the original carriage 2 in synchronism with the rotation of the photosensitive drum 3.

In copying on the electrostatic copying apparatus thus constructed, a main switch (not shown) is turned on, and then an original (not shown) is put on the original carriage 2. Subsequently, buttons on a control panel are operated for a desired copying mode. Accompanying the copying operation, the original carriage 2 reciprocates, the photosensitive drum 3 rotates, and the mechanical units operate severally.

The original on the original carriage 2 is illuminated by the illumination system 13, and an image of the original is formed on the photosensitive layer 3*a* through the optical fiber lens 14. Meanwhile, the photosensitive drum 3 has its photosensitive layer 3*a* charged by the charger 4. The image through the optical fiber lens 14 is formed on that portion of the photosensitive layer 3*a* which corresponds to the latter part of the charging process, and an electrostatic latent image is formed on the photosensitive layer 3*a*. The electrostatic latent image is changed into a toner image by the developing device 5, and the toner image is delivered to the transfer device 6.

In the paper feed system, on the other hand, the sheets of copying paper P are taken out sheet by sheet from the feed paper cassette 12 in accordance with the operation of the paper feed mechanism 9. Each sheet of transfer paper P taken out of the cassette 12 is carried through the paper path 8 to a transfer section defined as contact surfaces of the transfer device 6 and the photosensitive drum 3. By the action of the transfer device 6, the toner image is transferred to the transfer paper P at the transfer section. After the transfer process, the paper P is led by the paper discharge mechanism 10 into the fixer 11, where it is subjected to fixation. Thereafter, the paper P thus fixed is discharged into the paper discharge tray 13*a*, and thus a series of copying operations are completed. As for the portion of the photosensitive layer 3*a* having undergone the transfer process, it is thoroughly cleaned by the cleaning device 7 to provide for the next charging process.

In the aforementioned copying processes, the processing devices are brought in contact with the photosensitive layer 3*a*. Formed of a photosensitive coating film of zinc oxide which is high in strength, however, the photosensitive layer 3*a* will never be damaged by contact.

Figure 2:
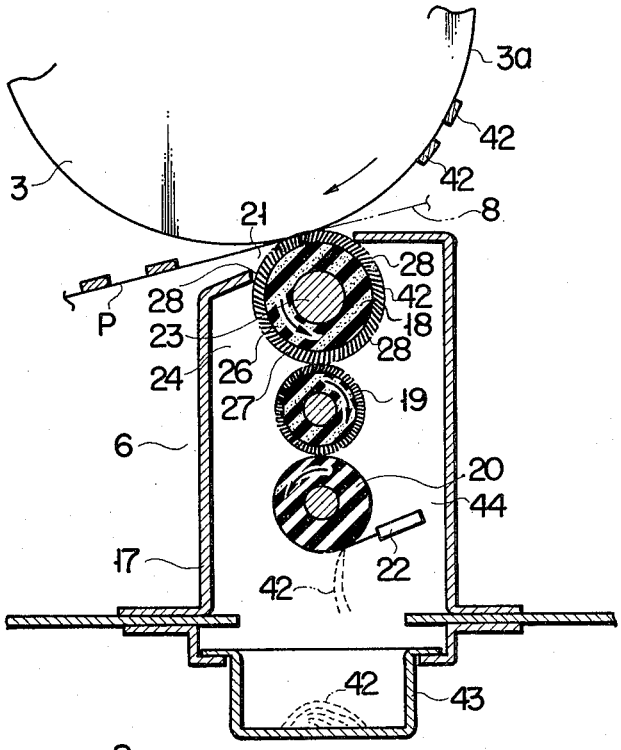
Figure 3:
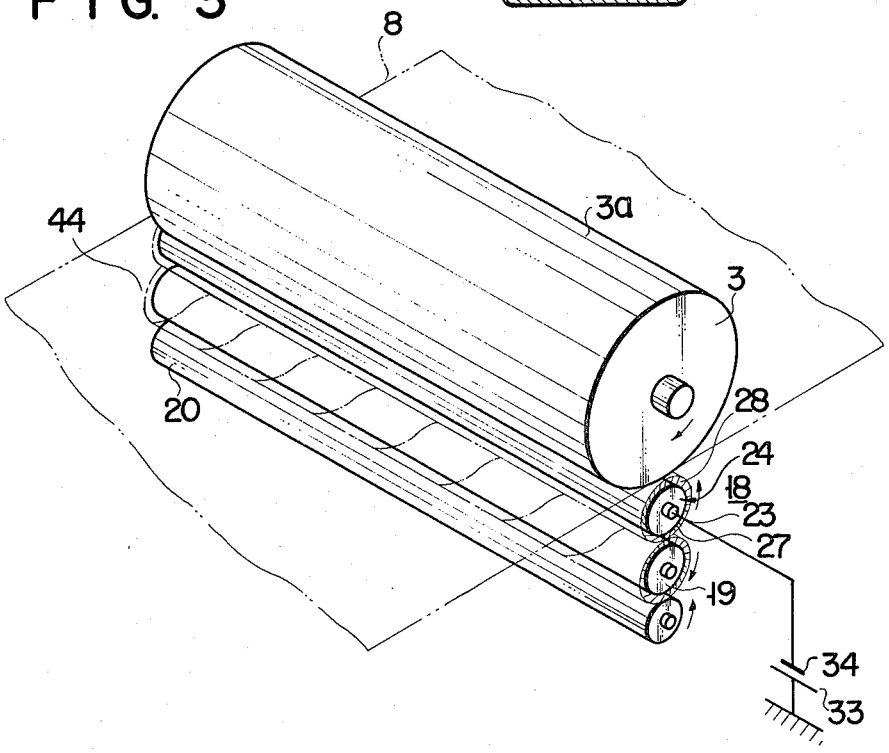

FIG. 2 shows the construction of the transfer device 6 used in the electrostatic copying apparatus of the above-mentioned construction. In FIG. 2, reference numeral 17 designates the main body of the transfer device 6 which is located under the photosensitive drum 3. In the main body 17, a first fur-brush roller 18 as a transfer roller, a second fur-brush roller 18 for cleaning, and a silicone rubber roller 20 are arranged successively from the upper side along the vertical direction. As shown in FIG. 3, the first fur-brush roller 18 extends along the axial direction of the photosensitive drum 3 to cover the overall length thereof. The top portion of the outer circumferential surface of the first fur-brush roller 18 is in rolling contact with the photosensitive layer 3*a* across an opening 21 on the upper side of the main body 17 and the paper path 8. Also, the second fur-brush roller 19 extends along the axial direction of the first fur-brush roller 18 to cover the overall length thereof. The top portion of the outer circumferential surface of the second fur-brush roller 19 is in rolling contact with the outer circumferential surface of the first fur-brush roller 18. Further, the silicone rubber roller 20 is in rolling contact with the bottom portion of the outer circumferential surface of the second fur-brush roller 19, extending along the axial direction of the roller 19 to cover the overall length thereof. A scraping blade 22 is fixed to the main body 17 so as to be in contact with the circumferential surface of the silicone rubber roller 20. The first and second fur-brush rollers 18 and 19 and the silicone rubber roller 20 are driven by an external driving unit (not shown) to rotate in the directions of their corresponding arrows of FIG. 3. Here, the circumferential speed ratio between these rollers (photosensitive drum 3:first fur-brush roller 18:second fur-brush roller 19:silicone rubber roller 20) is 1:1:2:3.

Now there will be described the respective constructions of the first and second fur-brush rollers 18 and 19.

Figure 4:
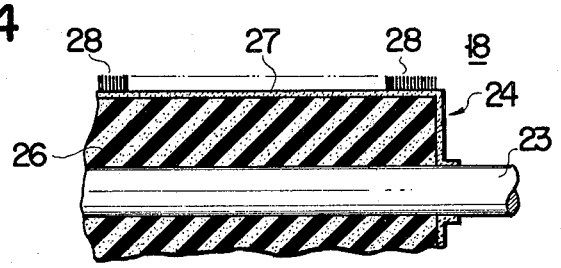

As shown in FIG. 4, the transfer roller 18 is in the form of a brush roll.

When bringing the fur-brush roller 18 into contact with the photosensitive layer 3*a* to use the roller 18 as a transfer roller, the following are to be attended to.

In general, the surface of the photosensitive layer 3*a* flaws easily, so that it is not advisable to press and rotate a rigid-surfaced roller on the photosensitive layer 3*a*. In order to improve the transfer efficiency, moreover, it is necessary that the transfer paper P be brought into contact with the photosensitive layer 3*a* with a certain dimension of contact area, and that the electrostatic effect be augmented by using a prescribed transfer time. In other words, the fur-brush roller 18 for transfer process need have flexibility and conductivity, and be able to provide stably fixed electric resistance. As for furs of the roller 18, they are expected to have uniform density, freedom from falling off, high resistance to abrasion, and susceptibleness to impression of bias potential.

Taking account of these circumstances, there will now be described in detail the construction of the first fur-brush roller 18 for transfer. In FIG. 4, numeral 23 designates a cylindrical core bar or shaft formed of e.g. aluminum. An elastic layer 26 of foaming polyurethane material with sufficient flexibility, such as e.g. EMM Polyurethane (trade name: MTP Kasei), is formed on the outer circumferential surface of the shaft 23. The core bar 23 and the elastic layer 26 constitute a highly flexible cylindrical core 24. The EMM Polyurethane layer used in this embodiment has a hardness ranging from 15 kg to 35 kg, preferably of 23±5 kg (based on JIS K-6401 Test Method), and a repellency of 45% or more. As shown in FIG. 4, moreover, an electrically conductive adhesive agent is continuously applied to the outer circumferential surface and end faces of the core 24 and a part of the shaft 23. After setting, the applied adhesive agent forms an electrically conductive layer 27 on the elastic layer 26. Namely, the shaft 23 and the conductive layer 27 are in conduction so that a bias potential may be applied to the conductive layer 27 by means of the shaft 23.

The conductive adhesive agent used is formed by mixing and kneading together 60 weight % of water-soluble Butyrol W-201 (trade name: Sekisui Kagaku), 10 weight % of glycerine, and 30 weight % of Carbon XC-72 (trade name: Cabot, Tokyo Zairyo). The conductive adhesive agent is water-soluble, and exhibits sufficient flexibility after setting, having its electric resistance set within a range of $10^4$ to $10^5$ Ω·cm. The water-soluble conductive adhesive agent of this type is characterized by its freedom from contraction after application and its capability of easily providing the desired electric resistance.

A great number of surface furs 28 are planted in the conductive layer 27 throughout the outer circumferential surface thereof. These surface furs 28 are composed of wear-resisting special rayon which is treated for electrical conductivity. The furs 28 used have a fiber length ranging from 0.5 mm to 3 mm, e.g. of 1.5 mm, density of 1.5 d (denier), and electric resistance ranging from $10^4$ to $10^{10}$ Ω·cm, e.g. from $10^8$ to $10^9$ Ω·cm. These furs 28 are planted in the conductive layer 27 by electrostatic fur planting method.

Figure 5:
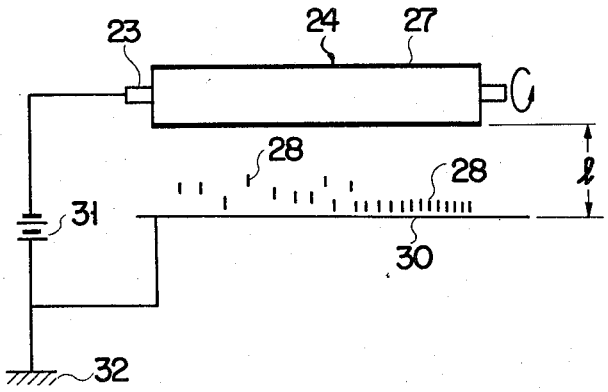

Referring now to FIG. 5, there will be described the electrostatic fur planting method. In FIG. 5, reference numeral 24 designates the core which is previously covered with the conduction layer 27 on its circumferential surface. The core 24 faces an electrode plate 30 with a prescribe space l between them. The shaft 23 of the core 24 and the electrode plate 30 are connected to the negative and positive terminals of a high-voltage power source 31, respectively. The positive terminal of the high-voltage power source 31 is also connected to a ground 32. The core 24 is rotated at a fixed speed by a driving mechanism (not shown). Symbol l denotes the given interpolar distance.

In planting furs, a great number of surface furs 28 are first put on the electrode plate 30, then the high-voltage power source 31 is put to work, and the core 24 is rotated. As a result, a high voltage is applied to the core 24 and the electrode plate 30 with the interpolar distance l kept between them, and the surface furs 28 are electrostatically attracted by the core 24. That is, the surface furs 28 are uniformly planted upright in the conductive layer 27 before setting. This electrostatic fur planting method can achieve secure fur planting over the circumferential surface of the core 24 without involving any fallen furs. Thus, the furs 28 with stable electric resistance can be planted effectively with ease.

In FIG. 3, reference numeral 33 denotes a bias supplying means which comprises the power source 34 connecting to the shaft 23. The bias supplying means 33 applies a bias potential to the surface furs 28 through the conductive layer 27.

Figure 6:
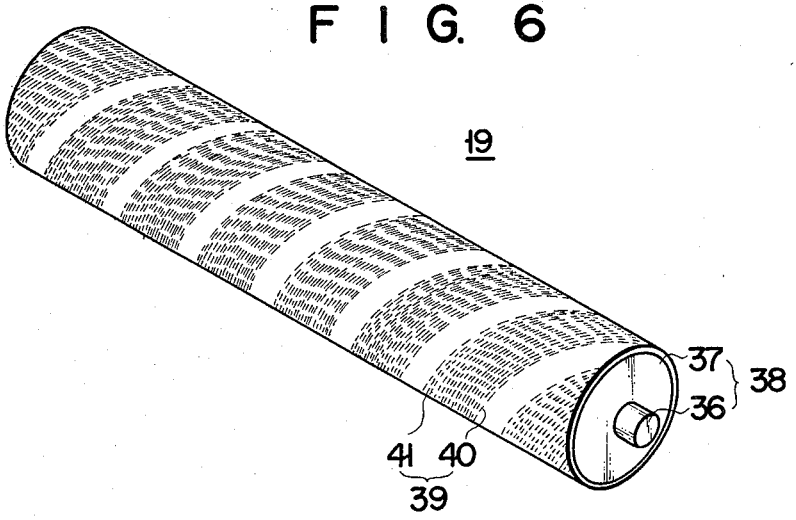

The second fur-brush roller 19 for cleaning is constructed as shown in FIG. 6.

Figure 7A:
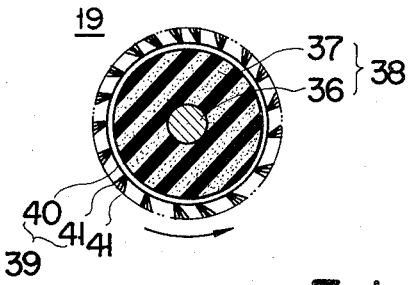
FIGS. 7*a* and 7*b* show a cross-sectional view of the second fur-brush roller of FIG. 6 and the arrangement of furs, respectively.
Figure 7B:
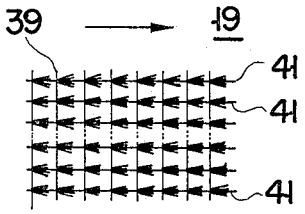

In FIG. 6, reference numeral 36 designates a shaft of the second fur-brush roller 19. Provided on the outer circumferential surface of the shaft 36 is a cylindrical elastic body 37 which is formed of a porous elastic member with flexibility and is coaxial with the shaft 36. The shaft 36 and the elastic body 37 form a core 38. A belt-shaped brush member 39 is spirally wound around the outer circumferential surface of the core 38. The core 38 and the brush member 39 constitute the second fur-brush roller 19. Etiquette Brush A-12-A (trade name: Nippon Seal) is used for the brush member 39. The Etiquette Brush is formed by intertwisting fifteen furs 41 of 14 d (denier) into a pile of 250 d, and napping and weaving a multitude of such piles into a belt-shaped foundation or cloth 40 with a density of 38,700 piles/inch$^2$. The napped furs 41 are arranged uniformly or in substantially the same direction. As shown in FIGS. 7*a* and 7*b*, the fur tips of the brush member 39 are all directed along the rotating direction of the fur-brush roller 19. Thus, toner particles 42 sticking to or lying among the surface furs 28 of the first fur-brush roller 18 for transfer may effectively be removed from the roller 18 after the formation of a toner image, taking advantage of the nature of the furs 41 of the brush member 39 and the elasticity of the first and second fur-brush rollers. The removed toner particles 42 are conveyed toward the silicone rubber roller 20. Namely, the function of the brush member 39 can ensure effective removal of toner particles and minimize the space for toner collection.

In FIG. 2, reference numeral 43 indicates a toner collector for collecting the toner particles 42 scraped off from the silicone rubber roller 20 by the scraping blade 22.

Referring now to FIGS. 2 and 3, there will be described the operation of the transfer device 6 of the above-mentioned construction.

First, accompanying the aforementioned copying operation, the first fur-brush roller 18 for transfer, the second fur-brush roller 19 for cleaning, and the silicone rubber roller 20 are driven to rotate in the directions of their corresponding arrows at a given circumferential speed. Hereupon, a bias potential is applied to the surface furs 28 of the first fur-brush roller 18. Thereafter, the copying paper P transmitted from the paper feed system reaches the rolling-contact section between the photosensitive layer 3*a* and the first fur-brush roller 18. At the contact section, the toner image formed on the photosensitive layer 3*a* is transferred to the copying paper P by the electrostatic effect of the surface furs 28. Then, the transfer process is finished after the lapse of the predetermined transfer time, and the copying paper P is delivered to the paper discharge system.

Meanwhile, the first fur-brush roller 18 continues to rotate after the transfer process is ended. Accordingly, the toner particles 42 remaining on the photosensitive layer 3*a* will stick to the surface furs 28 to soil the first fur-brush roller 18. These toner particles 42, however, are effectively removed in succession from the surface furs 28 and the spaces between the surface furs 28 by the furs 41 of the second fur-brush roller 19 which is in contact with the first fur-brush roller 18 and is rotating in the opposite direction to the rotating direction of the roller 18. The toner particles 42 thus removed are carried by the brush member 39 to reach the silicone rubber roller 20. Since the silicone rubber roller 20 is rotating in the forward direction of the tips of the furs 41, the toner particles 42 are effectively removed in succession from the furs 41 and the spaces between the furs 41. The toner particles 42 thus removed stick to the circumferential surface of the roller 20. Then, the toner particles 42 on the circumferential surface of the roller 20 are scraped off downwardly by the scraping blade 22. The scraped toner particles 42 are successively collected in the toner collector 43. In other words, all the toner particles 42 attached to the first fur-brush roller 18 are collected in the toner collector 43, so that the back side of the transfer paper P may be protected from soiling at the time of the next transfer process, for example.

Thus, with the transfer roller in the form of a brush roll, the transfer area of the photosensitive drum 3 can fully be increased with ease at transfer, making the most of the effective functions of the soft core 24 and the surface furs 28. At cleaning, moreover, satisfactory cleaning effect may be obtained with effective use of the core 24 and the surface furs 28 in the same manner.

As described above in detail, the fur-brush roller 18 performing both the transferring function and cleaning function is used in the present invention. Thus, the photosensitive layer *3a* is not damaged by the roller 18. Also, the surface of the roller 18 is not stained with the toner. It follows that the use of the fur-brush roller 18 permits improving the transfer efficiency and cleaning effect. Thus, the effect of the roller 18 as a transfer roller is great.

Since the brush member 39 is spirally wound around the outer circumferential surface of the second fur-brush roller 19, setting of the brush member 39 is facilitated.

Since the elastic layer 26 of EMM Polyurethane has a hardness ranging from 15 kg to 35 kg (based on JIS K-6401 Test Method), the contact area of the elastic layer 26 on the photosensitive drum 3 provided by its flexibility can effectively be increased to proper transfer time.

This invention is not limited to the above-mentioned embodiment. For example, the water-soluble conductive adhesive agent used for the conductive layer 27 in the above embodiment may be replaced with an oleaginous conductive adhesive agent of the following composition.

That is, the oleaginous conductive adhesive agent is obtained by diluting with toluene a mixture of 25 weight % of styrenebutadiene rubber, such as TUFPLANE (trade name: Asahi Kasei), 50 weight % of xylene resin, and 25 weight % of Carbon XC-72 (trade name: Cabot, Tokyo Zairyo), and kneading the mixture in ball mill for approximately two hours. The same effect can be obtained with use of such conductive adhesive agent. While the conductive adhesive agent of this type is characterized in that the rubber material is contracted as the toluene is evaporated, such contraction can be limited to a practically negligible degree by controlling the thickness of application.

Figure 8:
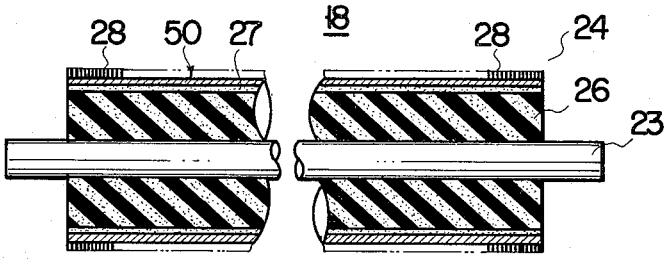
FIG. 8 is a sectional view showing a transfer device according to a second embodiment of the invention.
Figure 9A:
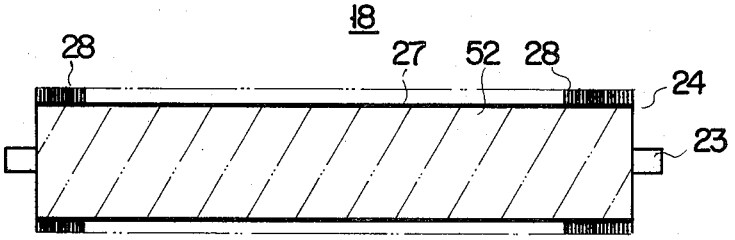
FIGS. 9*a* and 9*b* are a side view and a cross-sectional view showing a transfer device according to a third embodiment of the invention, respectively.
Figure 9B:
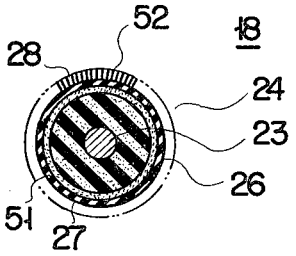

Although in the above embodiment the fur-brush roller for transfer is composed of a mere conductive layer as a core and surface furs provided on the conductive layer, such transfer roller may be formed as shown in FIG. 8 or FIGS. *9a* and *9b*.

FIG. 8 shows a second embodiment of the transfer device of the invention. In FIG. 8, a cylindrical brush cloth 50 is fixed to the outer circumferential surface of a core 24 across an electrically conductive adhesive agent layer 27. The brush cloth 50 is formed of an electrically conductive cylindrical cloth which is woven endlessly and napped. A fur-brush roller 18 for transfer is made up of the core 24 and the cylindrical brush cloth 50.

FIGS. *9a* and *9b* show a third embodiment of the transfer device of the invention. In these drawings, an electrically conductive thin rubber film 51 is formed over the outer circumferential surface of a core 24 across an electrically conductive adhesive layer 27. Further, a belt-shaped rayon-velvet member 52 is attached to the outer circumferential surface of the thin rubber film or layer 51. The velvet member 52 is obtained as a result of mordanting by a 30 minutes' boil in a 3% solution of potassium bichromate, washing by water, and drying. Thus, the velvet member 52 is provided with a group of belt-shaped surface furs 28. The velvet member 52 is spirally wound around the outer circumferential surface of the thin rubber layer 51 to form a first fur-brush roller 18 for transfer.

In the second and third embodiments, like and same reference numerals are used to designate the like same components used in the first embodiment, and description of such components is omitted.

As a modification of the third embodiment, the first fur-brush roller for transfer may be so constructed that an electrically conductive thin rubber layer is formed on a core, and surface furs are planted directly or via an electrically conductive adhesive layer in the outer circumferential surface of the thin rubber layer by the electrostatic fur planting method.

According to these embodiments of the invention, as described above, the transfer efficiency and cleaning effect may satisfactorily be improved without damaging the photosensitive layer by the transfer roller or soiling the surface of the roller itself with toner.

Further, the elastic body forming the core is made of foaming urethane with hardness ranging from 15 kg to 35 kg. Therefore, the photosensitive drum and the transfer roller can be brought in contact with each other with a fixed contact area by the effect of flexure provided by the elasticity of the transfer roller. Thus, there may be ensured increased transfer area and hence proper transfer time.

Furthermore, the surface furs are planted in the conductive layer by the electrostatic fur planting method. That is, short surface furs with length ranging from e.g. 0.5 mm to 3 mm can be uniformly planted at low cost so that they may be arranged along the normal line without the fear of falling off. Accordingly, the transfer roller of the invention is particularly effective when a bias potential is to be uniformly applied to the surface furs, or when the transfer roller is to be rotated while the surface furs are uniformly pressed against the image forming body.

With use of an electrically conductive layer formed on a part of the core bar, moreover, the bias potential may be applied to the surface furs by means of the core bar without using any separate conductive wire and roller. Namely, the construction for the supplying of the bias potential can be simplified.

By using for the conductive adhesive agent a water-soluble one which is formed by kneading a mixture of water-soluble butyral, glycerine, and carbon powder, furthermore, the core can be protected from distortion because the adhesive agent will never contract after application, and the desired electric resistance can be obtained with ease.

What we claim is:

1. In a transfer device for transferring a toner image formed on the surface of an image forming body to a copy medium, of the type comprising a rotatable transfer roller facing the image forming body and pressing the copying medium to the surface of the image forming body, the improvement comprising:

providing said transfer roller with elasticity to elastically press the copying medium to the surface of the image forming body thereby contacting with wider area, said transfer roller including a core provided with an outer circumferential surface and having a cylindrical rigid core bar and an elastic layer formed coaxially with said core bore on the outer circumferential surface thereof, an elastic and electrically conductive layer formed of an electrically conductive adhesive agent applied to said outer circumferential surface of said core, and a great number of electrically conductive furs electrostatically planted in said electrically conductive adhesive agent and projecting from the outer circumferential surface of said electrically conductive layer, said core bar having electrical conductivity and axially protruding from the end faces of said elastic layer, and said electrically conductive adhesive agent being a continuous layer applied to the outer circumferential surface of said core and part of said core bar; and a bias power source connected to said core bar for charging said copying medium.

2. A transfer device according to claim 1, wherein said electrically conductive layer is formed of an electrically conductive thin rubber layer attached to the outer circumferential surface of said core, and said furs are electrostatically planted in said electrically conductive thin rubber layer.

3. A transfer device according to claim 2, wherein said core bar has electrical conductivity and axially protrudes from the end faces of said elastic layer, and said electrically conductive thin rubber layer extends continuously from the outer circumferential surface of said core and part of said core bar.

4. A transfer device according to claim 3, which further comprises a bias power source for charging said copying medium, said bias power source being connected to said core bar.

5. A transfer device according to claim 1, wherein said electrically conductive layer is removably attached to said core, and said furs are electrostatically planted in said electrically conductive layer.

6. A transfer device according to claim 5, wherein said electrically conductive layer and furs form a cylindrical brush member removable from said core.

7. A transfer device according to claim 1 which further comprises cleaning means facing said transfer roller for cleaning said transfer roller, said cleaning means including a rotatable cleaning roller provided in contact with the transfer roller and receiving toner particles attached to the transfer roller, and scraping means provided in contact with the cleaning roller an elastic core having an outer circumferential surface, and a belt-shaped brush member spirally wound around the outer circumferential surface of said core, said brush member having a brush surface whose grain is directed against the rotation of said cleaning roller.

8. A transfer device according to claim 7, wherein said cleaning roller rotates in the opposite direction to the rotating direction of said transfer roller, and the speed of revolution of the cleaning roller is higher than that of the transfer roller.

9. A transfer device according to claim 8, wherein said scraping means faces said cleaning roller and rotates in the opposite direction to the rotating direction of said cleaning roller, including a roller for scraping which rotates at higher speed than that of said cleaning roller, whereby toner particles from said transfer roller held by the brush member of said cleaning roller are attached to the outer circumferential surface of said scraping roller.

10. A transfer device according to claim 9, wherein said scraping means further includes a scraping blade engaging the outer circumferential surface of the scraping roller along the axial direction thereof to scraping off the toner particles attached to said outer circumferential surface.

11. A transfer device according to claim 10, wherein the outer circumferential portion of said scraping roller is formed of silicone rubber.

* * * * *